US012492611B2

(12) United States Patent
Saraya et al.

(10) Patent No.: US 12,492,611 B2
(45) Date of Patent: Dec. 9, 2025

(54) METHODS AND SYSTEMS FOR A FRAC PLUG

(71) Applicant: Vertice Oil Tools Inc., Missouri City, TX (US)

(72) Inventors: Mohamed Saraya, Sugar Land, TX (US); Mike Lo, Houston, TX (US)

(73) Assignee: Vertice Oil Tools Inc., Missouri City, TX (US)

( * ) Notice: Subject to any disclaimer, the term of this patent is extended or adjusted under 35 U.S.C. 154(b) by 0 days.

(21) Appl. No.: 19/062,572

(22) Filed: Feb. 25, 2025

(65) Prior Publication Data

US 2025/0198252 A1 Jun. 19, 2025

Related U.S. Application Data

(63) Continuation of application No. PCT/US2023/036381, filed on Oct. 31, 2023.

(60) Provisional application No. 63/436,155, filed on Dec. 30, 2022.

(51) Int. Cl.
*E21B 33/128* (2006.01)

(52) U.S. Cl.
CPC ..... *E21B 33/128* (2013.01)

(58) Field of Classification Search
CPC ..... E21B 33/128
See application file for complete search history.

(56) References Cited

U.S. PATENT DOCUMENTS

| | | | | |
|---|---|---|---|---|
| 5,398,763 | A * | 3/1995 | Watson | E21B 23/02 166/242.6 |
| 9,080,416 | B2 * | 7/2015 | Xu | E21B 33/134 |
| 9,657,547 | B2 * | 5/2017 | Raggio | E21B 33/129 |
| 10,000,991 | B2 * | 6/2018 | Harris | E21B 33/1291 |
| 11,002,104 | B2 * | 5/2021 | Wolf | E21B 33/128 |
| 11,293,256 | B2 * | 4/2022 | Goodman | E21B 33/128 |
| 11,649,691 | B2 * | 5/2023 | Sommers | E21B 33/1292 166/387 |

* cited by examiner

*Primary Examiner* — Kenneth L Thompson
(74) *Attorney, Agent, or Firm* — Pierson IP, PLLC

(57) ABSTRACT

A frac plug with an object run in hole within a collet. Responsive to activating the collet or expandable element, the collet may slide out of the frac plug and expand to allow the object to be positioned across an inner diameter of the shorty plug, wherein the frac plug includes a bottom, and the expandable element is directly and temporarily coupled to the bottom.

19 Claims, 6 Drawing Sheets

METHODS AND SYSTEMS FOR A FRAC PLUG

BACKGROUND INFORMATION

Field of the Disclosure

Examples of the present disclosure relate to a frac plug. More specifically, embodiments are directed towards a shorty plug with an object run in hole within an expandable element. Responsive to activating the expandable element, the expandable element may slide out of the frac plug and expand to allow the object to be positioned across an inner diameter of the shorty plug.

Background

Conventionally, after cementing a well and to achieve frac/zonal isolation for a frac operation, a frac plug, and perforation guns on a wireline or other conveying methods (including fluid pumping) are pushed downhole to a desired depth. Then, the frac plug is set and the perforation guns are fired above to create a conduit to frac fluid. This enables the fracing fluid to be pumped. These conventional frac plugs are held in place via slips and seals via packing elements or O-rings, which may require complex operations and/or additional tools to set.

After an operation involving the downhole plug is complete, the plug must be removed from the wellbore or otherwise disposed of through milling or drilling. However, these operations can also be complex, time-consuming, and expensive. Further, running a bottom-set frac plug may not allow running a ball on a seat. For example, once the frac plug is set, a ball could be dropped from the surface to form a seal. This requires dropping balls from the surface, with associated fluid pumping, in which consumers consume frac fluid, time, and costs.

Alternatively, smaller balls are run in hole within pockets of a running tool, wherein the pocket is positioned between the outer diameter of a running tool and the inner diameter of a mandrel. These tools utilize a running tool that extends through the frac plug, wherein the running tool is later pulled out of the hole to expose the smaller ball within the pocket. The ball can then subsequently land on the frac plug. However, the downhole real estate occupied by the running tool and the pocket does not allow the downhole frac plug to have a larger inner diameter. This requires thicker frac plugs with smaller inner diameters.

Accordingly, needs exist for systems and methods for a single run frac plug that utilizes an object positioned within an expandable element, wherein the expandable element is configured to expand from a first inner diameter to a second inner diameter to allow the object to be positioned across an inner diameter of the frac plug.

SUMMARY

Embodiments disclosed herein describe systems and methods for a frac plug, wherein the frac plug may be a bottom set shorty frac plug that is dissolvable. The system may include the frac plug, expandable element, and blocking object.

The frac plug may be configured to operate as a check valve to provide wellbore zonal isolation in multistage stimulation treatments. Specifically, the frac plug may be configured to isolate a lower zone during stimulation, but allow communication via reverse flow. In embodiments, the frac plug may be a shorty frac plug. The frac plug may include may include a running tool cone, slip, and bottom.

The running tool may include a setting sleeve and an expandable element. The setting sleeve may be a mandrel, tube, etc. with a hollow passageway configured to apply forces against the cone, moving the cone under the slips, and causing the slips to radially expand. When the cone is being driven into the slips, the slips may radially expand outward to form a seal across an annulus. The slips may be configured to be set based on pressure or force being applied against the cone that causes the slips to radially move outward. For example, the slips may be expanded across an annulus to be positioned adjacent to the casing based on a downward force, via the setting sleeve, applied to the cone. However, the slips may be set based on any known method. Additionally, the setting sleeve may include a hollow passageway that allows fluid to flow through the setting sleeve if the setting sleeve is not sealed by the object.

The bottom may be positioned on a distal end of the frac plug, and adjacent to the slips. The bottom may include breakable threads and/or a shear pin. The breakable threads may be positioned on an inner diameter of a passageway of the bottom. In embodiments, the breakable threads and/or the shear pins may be configured to selectively and temporarily couple the running tool and the frac plug together, wherein the running tool and the frac plug may be run downhole from a surface together.

The expandable element may be a collet, segmented sleeve, band, collar, etc. that is configured to have an end with a variable inner diameter. The expandable element is configured to selectively secure the object within the expandable element based on the size of the end with the variable inner diameter. This may allow the object to be run in the hole within the inner diameter of the expandable element and only release the object responsive to decoupling the expandable element from the frac plug. The inner diameter of the end of the expandable element may be configured to conform to change based on radial forces applied to the outer diameter of the end of the expandable element. For example, in the first mode of operation the end with the variable inner diameter be positioned within, adjacent to, and aligned along a longitudinal axis of the frac plug with the bottom. This may cause the distal end of the expandable element to be smaller than an inner diameter across the bottom and the object. In a second mode, the end of the expandable element may no longer be aligned along the longitudinal axis with the frac plug or any other object, which may be caused by the setting sleeve moving the cone of the frac plug while the distal end of the expandable element remains stationary. In embodiments, when run in the hole from the surface, the expandable element may extend through the frac plug and be coupled to the bottom via a temporary coupling mechanism.

The object may be a ball, disc, or any other object that is configured to form a seal across the frac plug. The object may have an outer diameter that is larger than that of the inner diameter of a passageway through the frac plug. In embodiments, the object may be configured to be run in the hole within the expandable element along with the frac plug, wherein the object may be aligned with a central axis of the expandable element and frac plug when run in the hole from the surface. The object may be configured to be retained within the expandable element until the distal end of the expandable element is misaligned with, and positioned up hole from the inner diameter of the frac plug. This may allow the object to be run in the hole within the expandable element. Because the object is run in the hole within the expandable element along with the running tool and frac plug it is not required to drop a ball from the surface after the frac plug is positioned downhole or after the frac plug is set. Additionally, it is not required to run the smaller ball from the surface within a pocket that is offset from the central axis of the expandable element.

Specifically, when the inner diameter of the frac plug is aligned with the distal end of the expandable element, the frac plug may cause the inner diameter of the expandable element to be smaller than the diameter of the object. Responsive to no longer aligning the distal end of the expandable element with the inner diameter of the frac plug, the inner diameter of the end of the expandable element may expand to be wider than that of the object, and the inner diameter across the frac plug. This increase in size of the distal end of the expandable element may allow the object to move through the expandable element to be seated across the frac plug, and form a check valve across the frac plug. Specifically, the object may land on the frac plug while the running tool is being pulled out of the hole, after decoupling the running tool and the frac plug.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described concerning the following figures, wherein reference numerals refer to like parts throughout the various views unless otherwise specified.

Figure 1:
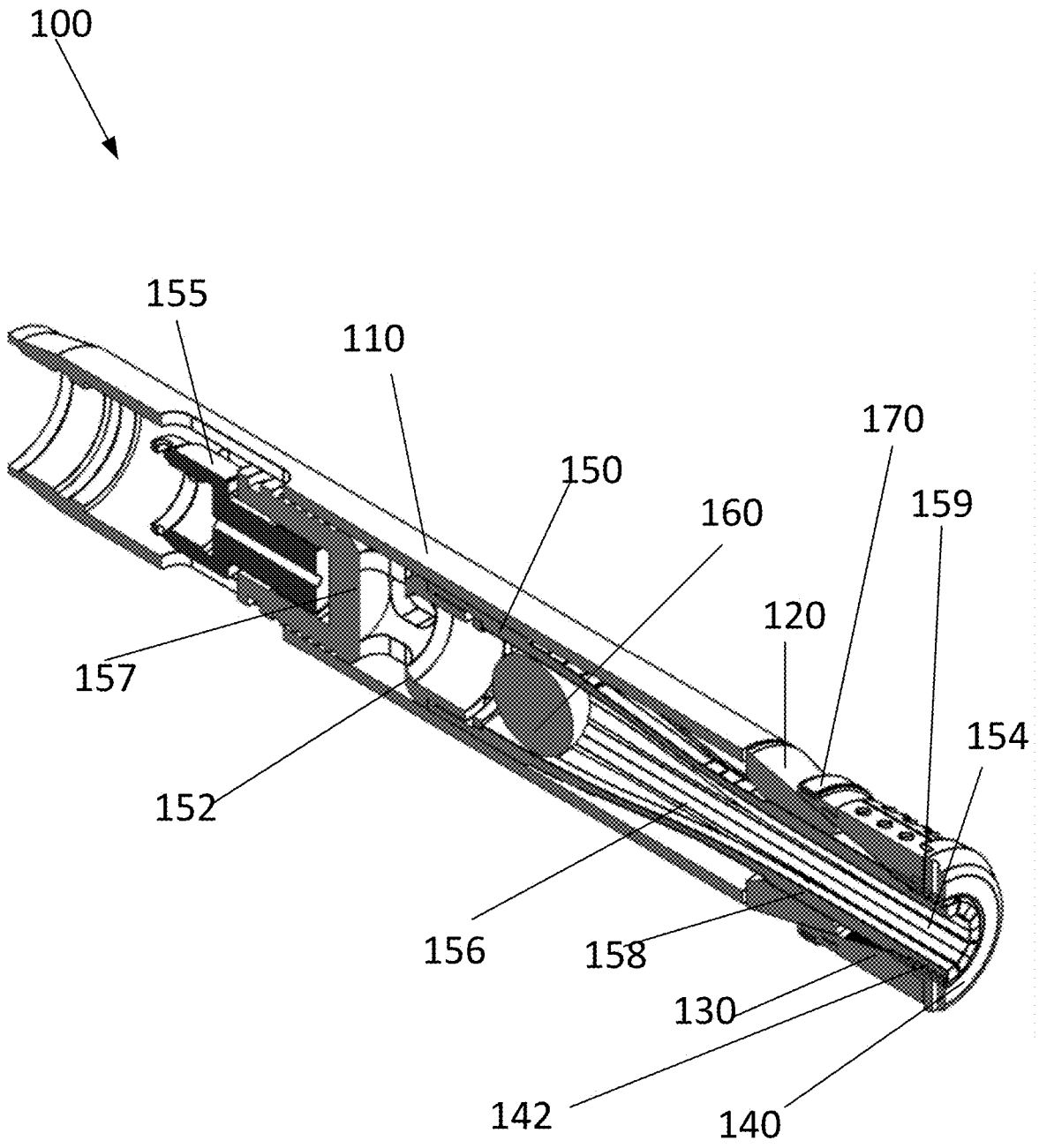
FIG. 1 depicts a system associated with a frac plug, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted to facilitate a less obstructed view of these various embodiments of the present disclosure.

DETAILED DESCRIPTION

In the following description, numerous specific details are outlined to provide a thorough understanding of the present invention. It will be apparent, however, to one having ordinary skill in the art that the specific detail need not be employed to practice the present invention. In other instances, well-known materials or methods have not been described in detail to avoid obscuring the present invention.

FIG. 1 depicts a system 100 associated with a frac plug, according to an embodiment. System 100 may enable an object 160 to be run in the hole along with an expandable element and a frac plug from the surface without having to position the ball within a pocket or having to drop a ball after the frac plug has reached a desired depth. To this end, system 100 may be configured to allow for a frac plug with a larger inner diameter to be automatically sealed without having to later position additional tools or objects downhole after a setting is pulled out of the hole.

System 100 may include a setting sleeve 110, frac plug, setting tool 155 with expandable element 150, and object 160.

Setting sleeve 110 may be a mandrel, tube, etc./ with a hollow passageway. Setting sleeve 110 may be configured to apply forces against cone 120 towards slips 130, moving cone 120 under the slips 130, causing the slips 130 to radially expand.

The frac plug may be configured to operate as a check valve to provide wellbore zonal isolation in multistage stimulation treatments. Specifically, the frac plug may be configured to isolate a lower zone during stimulation, but allow communication via reverse flow. The frac plug may include a cone 120, slips 130, and bottom 140. In other embodiments, frac plug may contain a bonded seal or packing element 170.

Cone 120 may be positioned between setting sleeve 110 and slips 130 when running in the hole. Cone 120 may include a tapered outer diameter that creates a ramp. Responsive to cone 120 being pushed towards slips 130, cone 120 may slide along a stationary outer diameter of the distal end 154 of expandable element 150, causing slips 130 to radially expand. In another embodiment a packing element 170 may be sandwiched between the slips 130 and the cones 120, thereby allowing packing element 170 to be compressed when the cone 120 is pushed against slips 130.

Slips 130 may be set based on pressure or force being applied by cone 120 that causes slip 130 to radially move outward. Slips 130 may be expanded across an annulus to be positioned adjacent to the casing based on a downward force, via the body, applied to cone 120. However, Slips 130 may be set based on any known method.

Bottom 140 may be positioned on a distal end of the frac plug, and adjacent to the slips 130. Bottom 140 may include a temporary coupling mechanism which may be a breakable threads and/or a shear pin. The breakable threads 142 may be positioned on an inner diameter of a passageway of the bottom 140. The breakable threads 142 and/or the shear pins may be configured to selectively and temporarily couple the expandable element 150 and the frac plug together, wherein the expandable element 150 and the frac plug may be run downhole from a surface together. In embodiments, responsive to the setting sleeve 110 setting the frac plug, the breakable threads 142 may break due to a stationary expandable element 150. Furthermore, before the frac plug is set, the inner diameters of cone 120, slips 130, and bottom 140 may be positioned directly adjacent to the outer diameter of expandable element 150. However, after setting the frac plug and removing the expandable element from the hole, none of the inner diameters of cone 120, slips, and bottom 140 may be positioned adjacent to the outer diameter of expandable element 150.

Expandable element 150 may be a collet, expandable dog, segmented sleeve, band, collar, etc. that is configured to have a distal end 154 with a variable or changing inner diameter. However, a proximal end 152 of expandable element 150 may have a fixed inner diameter. Expandable element 150 is configured to selectively secure object 160 within expandable element 150 based on the size of the distal end 154 with the variable inner diameter. This may allow object 160 to be run in the hole within the inner diameter of expandable element 150, wherein object 160 is run in the hole being positioned along a central axis of expandable element 150. Object 160 is released responsive to decoupling expandable element 150 from the frac plug and misaligning distal end 154 from the frac plug, wherein the decoupling of expandable element 150 from the frac plug allows an inner diameter across distal end 154 to increase in size.

Specifically, the inner diameter of the distal end 154 of the expandable element 150 may be configured to conform to change based on radial forces applied to the outer diameter of the distal end 154. For example, in the first mode of operation, the distal end 154 with the variable inner diameter be positioned within and adjacent to the frac plug bottom 140. This may cause an outer diameter across the distal end 154 to be smaller than an inner diameter across the bottom 140 and object 160. In a second mode, distal end 154 may no longer be aligned along the longitudinal axis with the frac plug or any other element. This may cause no forces applied to the outer diameter of distal end 154, allowing the variable inner diameter of distal end 154 to return to its natural state, wherein the inner diameter of distal end 154 is longer than the inner diameter across the bottom 140 or the object 154.

In implementations, expandable element 150 may have a proximal end 152, fingers 156, distal end 154, outer profile 158, and threads 159.

The proximal end 152 may be positioned on an opposite end of expandable element 150 as the distal end 154. The proximal end 152 may include a first fixed inner diameter, wherein the fixed inner diameter does not increase or decrease in size. Furthermore, the first fixed inner diameter may be bigger than the diameter across object 160. This may allow object 160 to be inserted into an expandable object before being run in a hole. In embodiments, the proximal end 152 may also include a no-go 157, which may not allow object 160 to flow out of proximal end 152 when expandable element 150 is run in a hole.

Fingers 156 may extend from the proximal end 152 to the distal end 154. Fingers 156 may be segmented, such that a diameter across fingers 156 may change to correspond to a device positioned on the outer diameter of fingers 156. In embodiments, if no forces are applied to an outer circumference of fingers 156, then fingers 156 may have a larger inner diameter than object 160 and/or cone 120. Furthermore, when forces are applied to the outer circumference of fingers 156 to retain fingers 156 in a compressed state, then the inner diameter of fingers 156 may gradually and continuously taper from the proximal end 152 to the distal end 154. Additionally, when forces are applied to an outer circumference of fingers 156, then the inner diameter across fingers 156 may decrease in size to have a smaller inner diameter than object 160 and/or cone 120.

Alternatively, when no forces are applied to the outer circumference of fingers 156, and fingers 156, are in their natural state then the inner diameter of fingers 156 may be substantially the same from proximal end 152 to distal end 156. This inner diameter may be larger than the diameter across object 160.

In embodiments, fingers 156 may have a profile on their outer diameter that causes a variable-sized outer diameter when fingers 156 are in their natural state and/or compressed state. Specifically, fingers 156 may have an abutment 158, projection, etc. that increases the outer diameter of fingers 156. When in the collapsed mode, the abutment 158 may be positioned against the inner diameter of cone 120. When fingers 156 are in their natural state, no outside pressure is applied against the abutment 158 by cone 120

The distal end 154 of expandable element 150 may include threads 159 that are configured to selectively couple expandable element 150 and bottom 140 together. Threads 159 may be breakable threads that are configured to break to decouple distal end 154 from bottom 140 responsive to setting sleeve 110 pushing the frac plug downhole. One skilled in the art may appreciate that threads 159 may be any temporary coupling mechanism that is configured to break, shear, etc., such as shear screws or pins.

Object 160 may be a ball, disc, or any other object that is configured to form a seal across the frac plug. Object 160 may have an outer diameter that is larger than that of an inner diameter of a passageway through the frac plug and expandable element 150 when expandable element 150 is in the collapsed position. In embodiments, Object 160 may be configured to be run in the hole within the expandable element 150 along with the frac plug. When object 160 is run in the hole it may be aligned with a central axis of the expandable element 150 and frac plug, and positioned between no-go 157 and distal end 154. This may allow object 160 to be run in the hole within the collet, such that it is not required to drop a ball within the hole after the frac plug is positioned downhole or after the frac plug is set. Specifically, object 160 may be positioned within expandable element 150 that is directly coupled to bottom 140 before setting the frac plug. Object 160 may be configured to be retained within the expandable element 150 until distal end 154 of the expandable element 150 is no longer aligned with the inner diameter of the frac plug. Inward radial forces against the outer diameter of the expandable element 150 caused by the inner diameter of the frac plug may maintain the inner diameter across the distal end 154 of the expandable element 150 to be smaller than the diameter of the object. Responsive to no longer aligning distal end 154 the inner diameter of the frac plug by positioning distal end 154 up the hole from the frac plug, the inner diameter of distal end 154 may expand to be larger than that of object 160 and the inner diameter across the frac plug. This increase in the size of the distal end 154 of the expandable element may allow object 160 to be seated across the frac plug and form a check valve across the frac plug.

Figure 2:
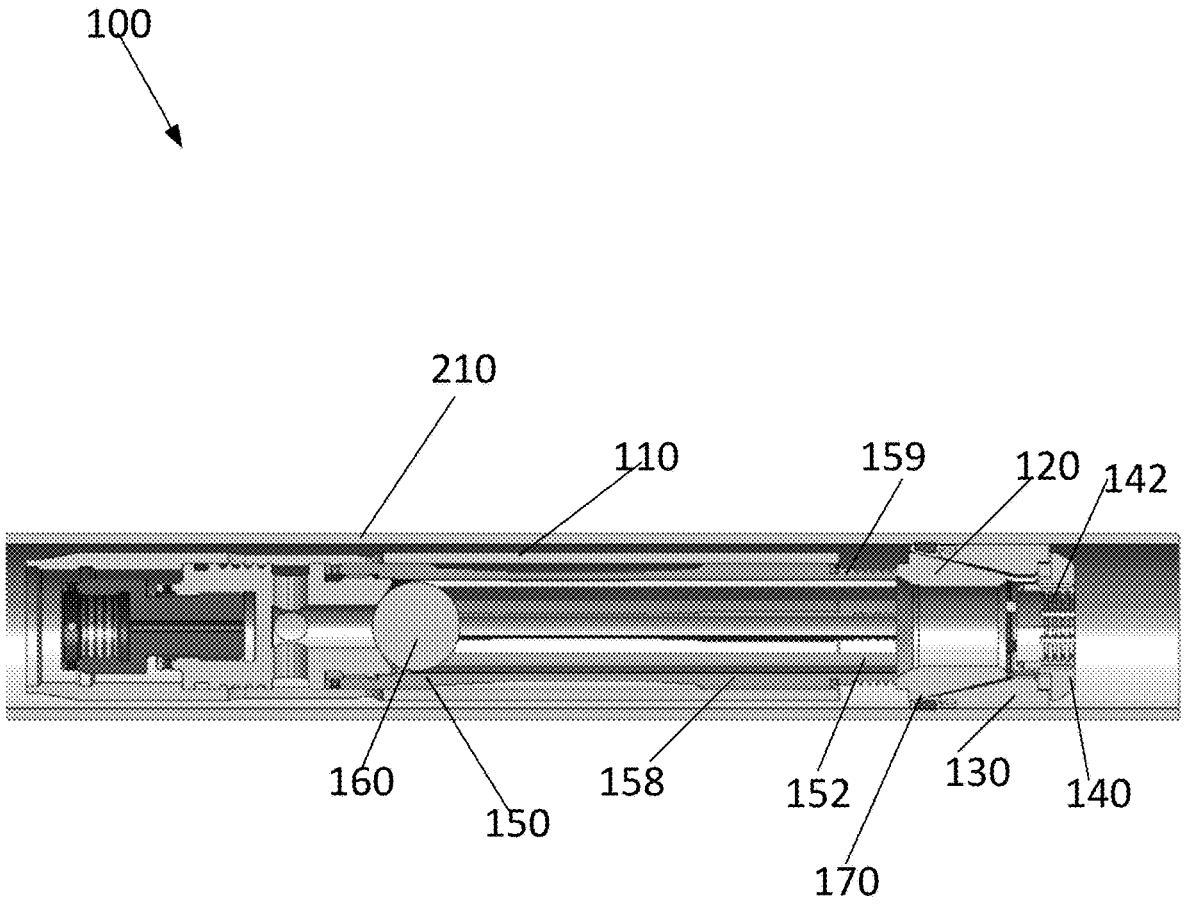
FIG. 2 depicts a side cross-sectional view of a system after the frac plug has been set, according to an embodiment.
Figure 3:
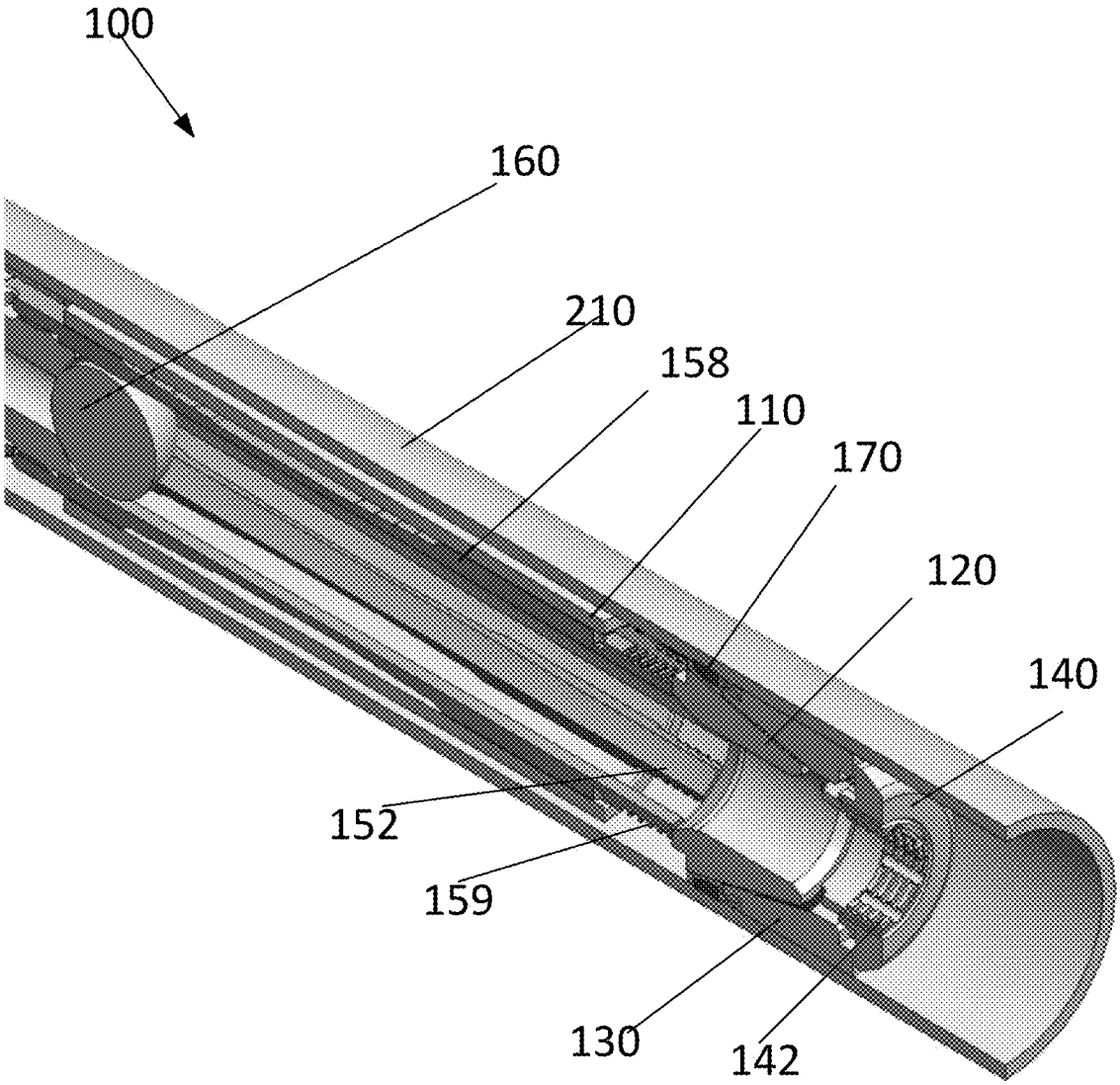
FIG. 3 depicts a perspective cross-sectional view of a system after the frac plug has been set, according to an embodiment.

FIG. 2 depicts a side cross-sectional view of system 100 after the frac plug has been set and FIG. 3 depicts a perspective cross-sectional view of system 100 after the frac plug has been set, according to an embodiment. Elements depicted in FIGS. 2 and 3 may be described above, and for the sake of brevity, another description of these elements may be omitted.

As depicted in FIG. 3, setting sleeve 110 may be configured to push or otherwise move cone 120 in a first direction, while expandable element 150 remains relatively fixed in place. The movement of cone 120 may cause slips 130 to radially expand and grip the inner diameter of casing 210.

Due to the relative movement of cone 150 concerning expandable element 150, when cone 120 is being pushed in the first direction temporary coupling mechanism 142 on the inner diameter of bottom sub 140 may be sheared from profile 159 on the outer diameter of expandable element 150.

This may allow distal end 152 of expandable element 150 to no longer be positioned within the frac plug, which may allow for the automatic radial expansion of distal end 152.

Figure 4:
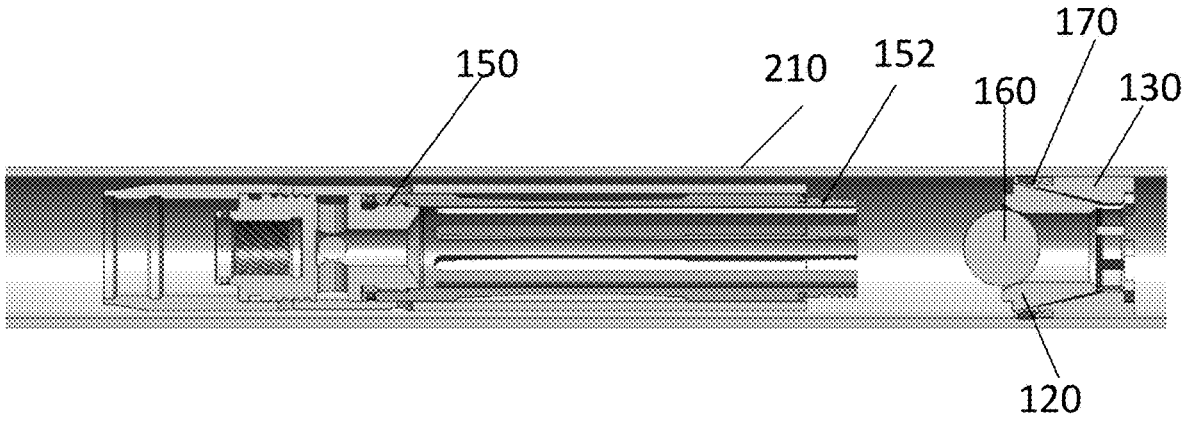
FIG. 4 depicts a side cross-sectional view of a system after an object has landed on the frac plug, according to an embodiment.
Figure 5:
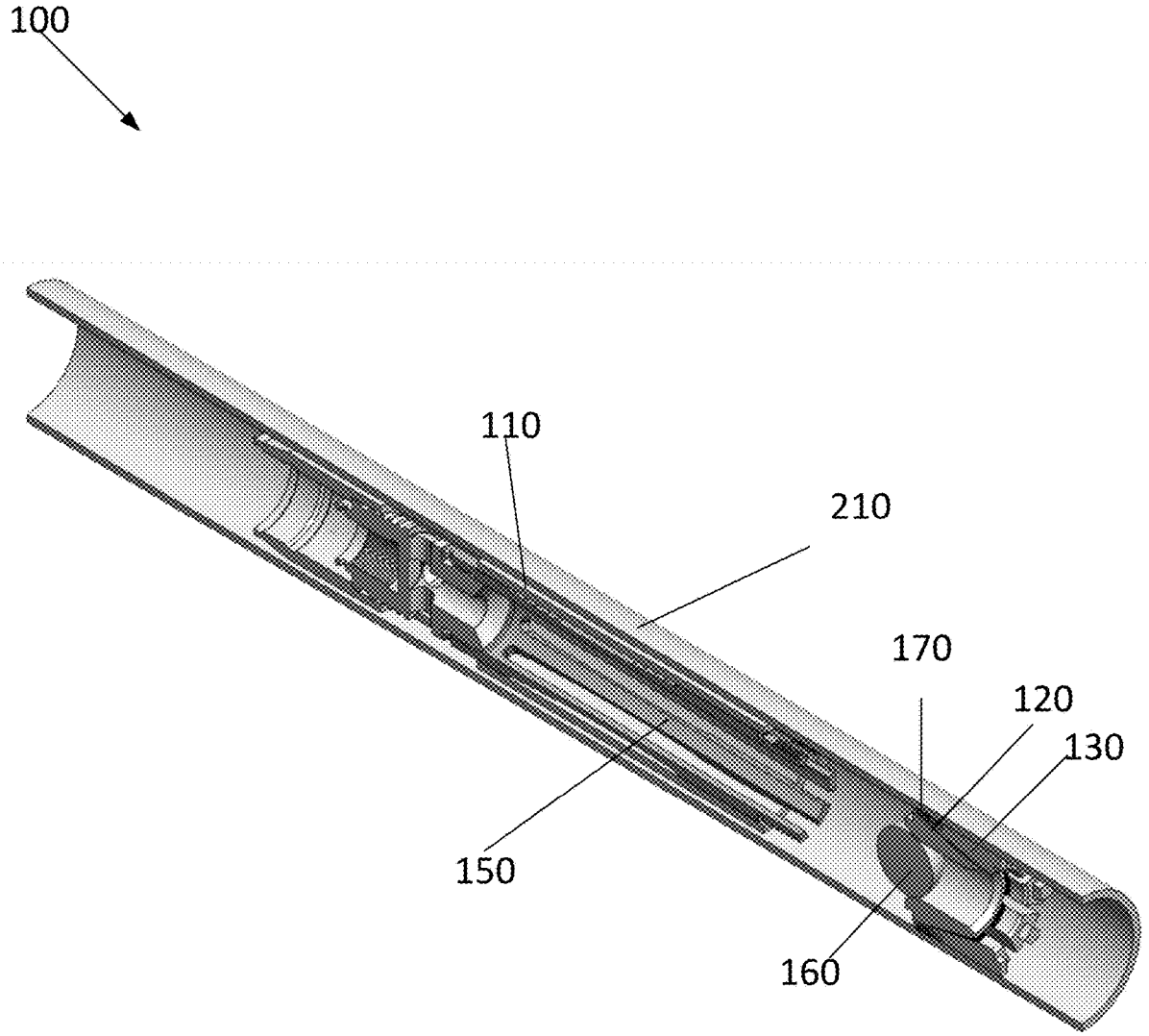
FIG. 5 depicts a perspective cross-sectional view of a system after an object has landed on the frac plug, according to an embodiment.

FIG. 4 depicts a side cross-sectional view of system 100 after object 160 has landed on the frac plug, and FIG. 5 depicts a perspective cross-sectional view of system 100 after object 160 has landed on the frac plug, according to an embodiment. Elements depicted in FIGS. 4 and 5 may be described above, and for the sake of brevity, another description of these elements may be omitted.

As depicted in FIGS. 4 and 5, responsive to distal end 152 no longer being positioned within the frac plug the distal end 152 may automatically return to its natural state, which has a larger inner diameter than the diameter of object 160. This may allow object 160 to move from a first position within expandable element 150, move entirely along the longitudinal axis of system 100, without having to be positioned within a pocket, and land on cone 120. When object 160 lands on cone 120, object 160 may form a check valve across cone 120. This may allow for a one-way flow of fluid through the frac plug while limiting the flow of fluid in a second direction.

Furthermore, while object 160 is moving downhole the expandable element 150 and setting sleeve 110 may move in a second direction. This may allow expandable element 150 and the setting sleeve to be pulled out of the hole together while object 160 remains downhole, and land on the frac plug.

Figure 6:
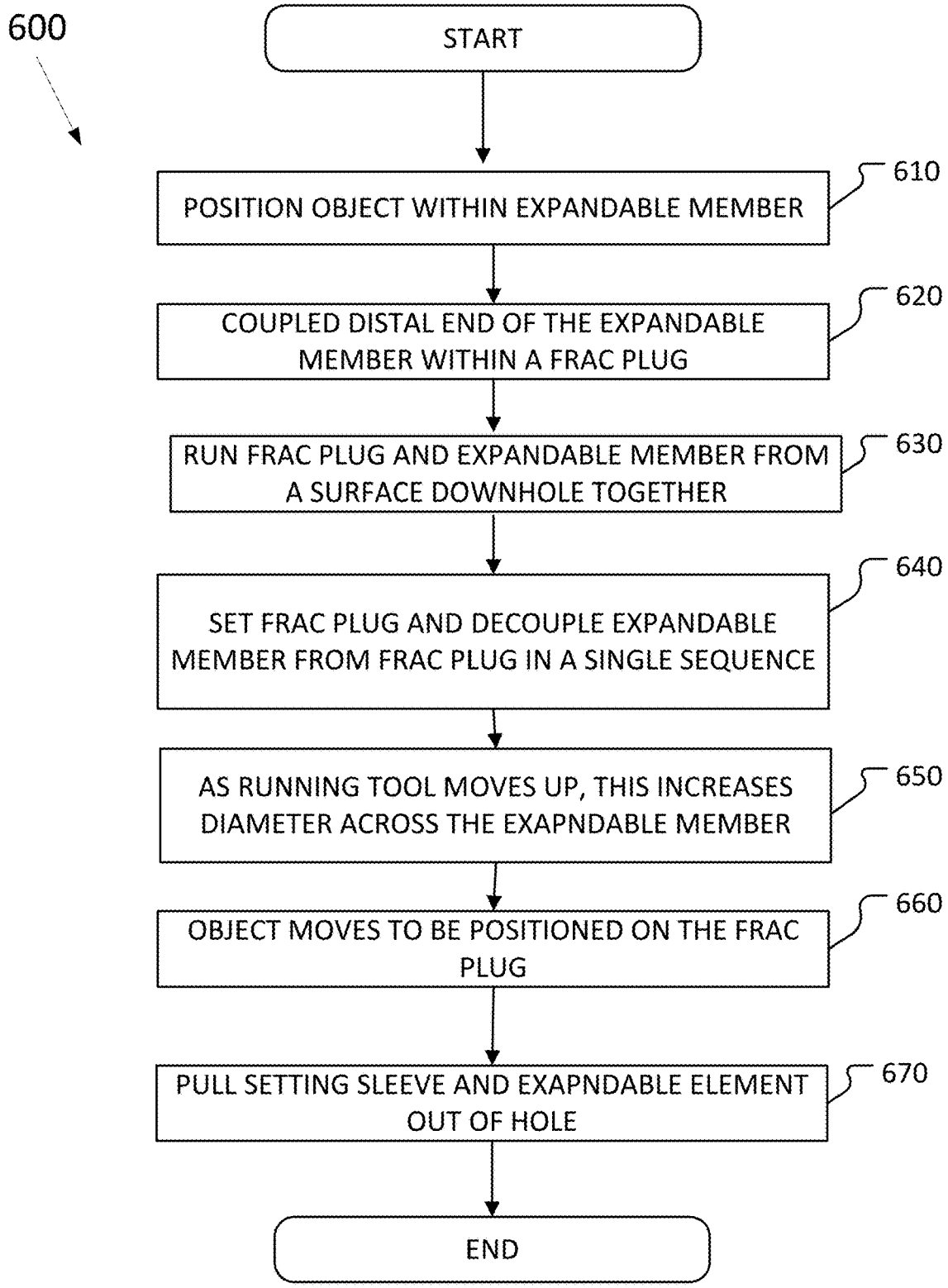
FIG. 6 illustrates a method for an object within an expandable element, according to an embodiment.

FIG. 6 illustrates method 600 for running an object within an expandable element, according to an embodiment. The operations of method 600 presented below are intended to be illustrative. In some embodiments, method 600 may be accomplished with one or more additional operations not described, and/or without one or more of the operations discussed. Additionally, the order in which the operations of method 600 are illustrated in FIG. 6 and described below is not intended to be limiting.

At operation 610, an object may be positioned within an expandable element, such as a collet. In embodiments, the object may be positioned within the expandable element by radially opening the distal end of the object to be larger than a diameter across the object.

At operation 620, the distal end of the expandable element may be positioned within a frac plug, wherein the distal end of the expandable element is temporarily coupled to the frac plug. Responsive to positioning the distal end of the expandable element within the frac plug, an inner diameter across the distal end of the expandable element may be smaller than that of the diameter across the object. This relative sizing may temporarily restrict the object from moving out of the distal end of the object.

At operation 630, the expandable element and the object may be positioned within a hole at a top surface, and travel to a desired depth together.

At operation 640, a setting sleeve may push the frac plug downhole. Responsive to moving the frac plug downhole, threads, screws, and/or pins coupling the distal end of the expandable element may shear, and the setting sleeve may move a cone of the frac plug to radially expand slips. Responsive to radially expanding the slips, the slips may grip the casing.

At operation 650, the distal end of the expandable element and the frac plug may be misaligned. This may allow the distal end of the expandable element to automatically increase its diameter to be larger than that of a diameter across the object.

At operation 660, the object may automatically travel directly along a central axis of the expandable element to be positioned on the cone of the frac plug. In embodiments, the object may travel directly from the expandable element onto the frac plug without passing through any other mandrel, sliding sleeve, or other tubular element.

At operation 670, the setting sleeve and the expandable element may be pulled out of the hole together while the object remains on the frac plug. In embodiments, the object may land on the frac plug while the setting sleeve and the expandable element are being pulled out of the hole.

Reference throughout this specification to "one embodiment", "an embodiment", "one example" or "an example" means that a particular feature, structure, or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A downhole tool comprising:

a frac plug with a first inner diameter;

an expandable element with a variable-sized inner diameter configured to be selectively coupled with the frac plug, wherein the variable sized inner diameter is configured to be smaller than the first inner diameter in a collapsed mode and is configured to be equal to or larger than the first inner diameter in an expanded mode, wherein the frac plug includes a bottom, and the expandable element is directly and temporarily coupled to the bottom, wherein the expandable element is in the collapsed mode when coupled to the bottom; and an object configured to be positioned within the expandable element in the collapsed mode before the expansion of the expandable element.

2. The downhole tool of claim 1, wherein the variable sized inner diameter of the expandable element is across a distal end of the expandable element, while a proximal end inner diameter of the expandable element has a constant size.

3. The downhole tool of claim 1, wherein the expandable element is coupled to the frac plug via a temporary coupling mechanism, the temporary coupling mechanisms being one of shear pins, breakable threads, or a mechanical element that is configured to be sheared once a predetermined force is applied to it.

4. The downhole tool of claim 1, wherein the object is configured to be positioned across the first inner diameter after the expandable element is in the expanded mode.

5. The downhole tool of claim 4, wherein the object is a ball.

6. The downhole tool of claim 5, wherein the object is run in hole positioned along a central axis of the downhole tool, wherein the object moves along the central axis of the downhole tool after the expandable element moves from the collapsed mode to the expanded mode.

7. The downhole tool of claim 5, wherein the frac plug, the expandable element, and the object are run in hole together in a same trip from a surface.

8. The downhole tool of claim 5, wherein the object has an outer diameter that is larger than the first inner diameter.

9. The downhole tool of claim 5, wherein the object travels directly from the expandable element to the frac plug after the expandable element is pulled out of the frac plug.

10. The tool of claim 1, wherein the expandable element is directly and temporarily coupled to the bottom of the frac plug while in the collapsed mode.

11. The tool of claim 1, wherein the object comprises an element configured to selectively block fluid flow across the first inner diameter.

12. The tool of claim 1, wherein expansion of the expandable element is caused by axial movement of a setting sleeve, hydraulic pressure, or mechanical actuation, thereby releasing the object from the expandable element.

13. The tool of claim 1, wherein, during a downhole operation:

the object is positioned within the expandable element in the collapsed mode;

the frac plug and expandable element are run downhole together; and expansion of the expandable element causes the object to seat across the first inner diameter of the frac plug to isolate fluid communication.

14. A method associated with a downhole tool comprising:

running a frac plug with a first inner diameter and an expandable element downhole together, the expandable element having variable sized inner diameter configured to be selectively coupled with the frac plug;

collapsing the expandable element to decrease the variable-sized inner diameter to be smaller than the first inner diameter in a collapsed mode; expanding the expandable element so that the variable-sized inner diameter is equal to or larger than the first inner diameter in an expanded mode; wherein the frac plug includes a bottom, and the expandable element is directly and temporarily coupled to the bottom;

positioning an object within the expandable element in the collapsed mode, wherein the expandable element is in the collapsed mode when coupled to the bottom.

15. The method of claim 14, wherein the expandable element is a collet, and coupling a distal end of the expandable element within the first inner diameter of the frac plug when run in hole.

16. The method of claim 14, wherein the variable sized inner diameter of the expandable element is a distal end of the expandable element, while a proximal end inner diameter of the expandable element remains constant.

17. The method of claim 14, further comprises:

shearing a temporary coupling mechanism to decouple the expandable element and the frac plug, the temporary coupling mechanisms being one of shear pins, breakable threads, or a mechanical element that is configured to be sheared once a predetermined force is applied to it.

18. The method of claim 14, further comprises:

transitioning the expandable element from the collapsed mode to the expanded mode;

positioning the object across the first inner diameter after the expandable element is in the expanded mode.

19. A downhole tool comprising:

a frac plug having a first inner diameter;

an expandable element with a variable-sized inner diameter, the expandable element configured to be selectively coupled to a bottom portion of the frac plug, the expandable element having a collapsed mode and an expanded mode, the variable-sized inner diameter being smaller than the first inner diameter in the collapsed mode and equal to or larger than the first inner diameter in the expanded mode; and an object positioned within the expandable element in the collapsed mode, the object being configured to move into sealing engagement across the first inner diameter after the expandable element transitions from the collapsed mode to the expanded mode.

* * * * *